US008231200B2

(12) United States Patent
Tamaki

(10) Patent No.: US 8,231,200 B2
(45) Date of Patent: Jul. 31, 2012

(54) INK-JET RECORDING APPARATUS

(75) Inventor: Shuichi Tamaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 310 days.

(21) Appl. No.: 12/652,458

(22) Filed: Jan. 5, 2010

(65) Prior Publication Data

US 2010/0194819 A1 Aug. 5, 2010

(30) Foreign Application Priority Data

Jan. 30, 2009 (JP) ..... 2009-019137

(51) Int. Cl.
*B41J 2/165* (2006.01)

(52) U.S. Cl. ..... 347/29; 347/30

(58) Field of Classification Search ..... 347/29, 347/30

See application file for complete search history.

(56) References Cited

U.S. PATENT DOCUMENTS

| | | | | |
|---|---|---|---|---|
| 5,912,681 | A * | 6/1999 | Uetuki et al. | 347/29 |
| 6,017,109 | A * | 1/2000 | Saijo | 347/30 |
| 6,312,092 | B1 | 11/2001 | Usui et al. | |
| 6,491,369 | B1 * | 12/2002 | Satoh et al. | 347/30 |
| 2002/0075348 | A1 * | 6/2002 | Shindo et al. | 347/29 |
| 2004/0155920 | A1 * | 8/2004 | Umeda et al. | 347/30 |
| 2007/0139464 | A1 * | 6/2007 | Suzuki | 347/30 |
| 2007/0176962 | A1 * | 8/2007 | Ogawa | 347/29 |

FOREIGN PATENT DOCUMENTS

| | | | |
|---|---|---|---|
| JP | H07-195712 | A | 8/1995 |
| JP | H08-020120 | A | 1/1996 |
| JP | H08-142345 | A | 6/1996 |
| JP | H09-300641 | A | 11/1997 |
| JP | H10-264402 | A | 10/1998 |
| JP | 2002-240325 | A | 8/2002 |
| JP | 2004-034477 | A | 2/2004 |
| JP | 2004-050581 | A | 2/2004 |
| JP | 2007-021907 | A | 2/2007 |
| JP | 2007-196443 | A | 8/2007 |

OTHER PUBLICATIONS

Japan Patent Office; Notification of Reason(s) for Refusal for Patent Application No. JP2009-019137, dated Oct. 19, 2010. (counterpart to above-captioned U.S. patent application).

* cited by examiner

*Primary Examiner* — Shelby Fidler
(74) *Attorney, Agent, or Firm* — Baker Botts L.L.P.

(57) ABSTRACT

An ink-jet recording apparatus, including: an ink-jet head; a cap including a support member, an annular protrusion which defines a recessed portion with the support member, and a discharge opening formed in a bottom surface of the recessed portion; a discharge mechanism; a plate member disposed in the recessed portion such that a space is formed between the plate member and the bottom surface and such that there is formed, between an inner peripheral surface of the cap and the plate member, a gap in which a capillary phenomenon occurs; protrusions disposed on an upper surface of the plate member, each protrusion extending in a direction intersecting a longitudinal direction of the head from one end to the other end of the upper surface in a direction perpendicular to the longitudinal direction; and separations each of which divides the corresponding protrusion into segments in the direction intersecting the longitudinal direction.

10 Claims, 10 Drawing Sheets

INK-JET RECORDING APPARATUS

CROSS REFERENCE TO RELATED APPLICATION

The present application claims priority from Japanese Patent Application No. 2009-019137, which was filed on Jan. 30, 2009, the disclosure of which is herein incorporated by reference in its entirety.

BACKGROUND OF THE INVENTION

1. Field of the Invention

The present invention relates to an ink-jet recording apparatus configured to eject ink on a recording medium.

2. Discussion of Related Art

There is known an ink-jet recording apparatus configured to perform a purging operation in which ink is discharged into a cap for restoring an ejection performance of a recording head. In the cap of the recording apparatus, there is disposed a flow restricting member having a rectangular shape in plan view. The flow restricting member is formed with a plurality of through-holes so as to be distributed over the entirety of the flow restricting member. The through-holes formed at a central portion of the flow restricting member have a diameter smaller than that of the through-holes formed in opposite end portions thereof. According to the arrangement, when the ink in the cap is sucked through an ink discharge opening, a resistance to the ink flow from the central portion to the ink discharge opening is larger than a resistance to the ink flow from the opposite end portions to the ink discharge opening. Consequently, the ink flow in the cap can be uniformalized.

SUMMARY OF THE INVENTION

In the apparatus described above, since the multiplicity of through-holes are formed in the flow restricting member, the force for sucking the ink through each through-hole at the time when the ink is discharged from the cap is considerably lowered. Accordingly, a large amount of the ink tends to remain in the cap, in particular, on the flow restricting member, without being sucked. The ink remaining on the flow restricting member tends to contact the atmosphere, so that the ink tends to be dried. When an ejection surface of the recording head is covered with the thus formed cap for preventing drying of ink in ink ejection openings of the recording head, the dried ink on the flow restricting member absorbs the aqueous component of the ink in the vicinity of the ink ejection openings, so that the viscosity of the ink in the vicinity of the ink ejection openings is undesirably increased.

It is therefore an object of the invention to provide an ink-jet recording apparatus capable of preventing ink from staying or remaining on a plate member disposed in a cap and capable of efficiently discharging ink.

The above-indicated object may be attained according to a principle of the invention, which provides an ink-jet recording apparatus, comprising:

an ink-jet head having an ejection surface in which are formed a plurality of ejection openings through which ink is ejected;

a cap including: a support member; an annular protrusion which is fixed to the support member and which is to come into contact with the ejection surface, the annular protrusion cooperating with the support member to define a recessed portion for covering the plurality of ejection openings; and a discharge opening formed in a bottom surface of the recessed portion;

a discharge mechanism configured to discharge ink purged from the ink-jet head into the cap, through the ink discharge opening;

a plate member disposed in the recessed portion of the cap such that a space is formed between the plate member and the bottom surface and such that there is formed, between an inner surface of the cap and the plate member, a gap in which a capillary phenomenon occurs;

a plurality of protrusions which are formed on an upper surface of the plate member so as to be arranged in a longitudinal direction of the ink-jet head and each of which extends in a direction intersecting the longitudinal direction from one end to the other end of the upper surface in a direction perpendicular to the longitudinal direction; and a plurality of separations by each of which a corresponding one of the plurality of protrusions is divided into segments in the direction intersecting the longitudinal direction.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENTS

Figure 1:
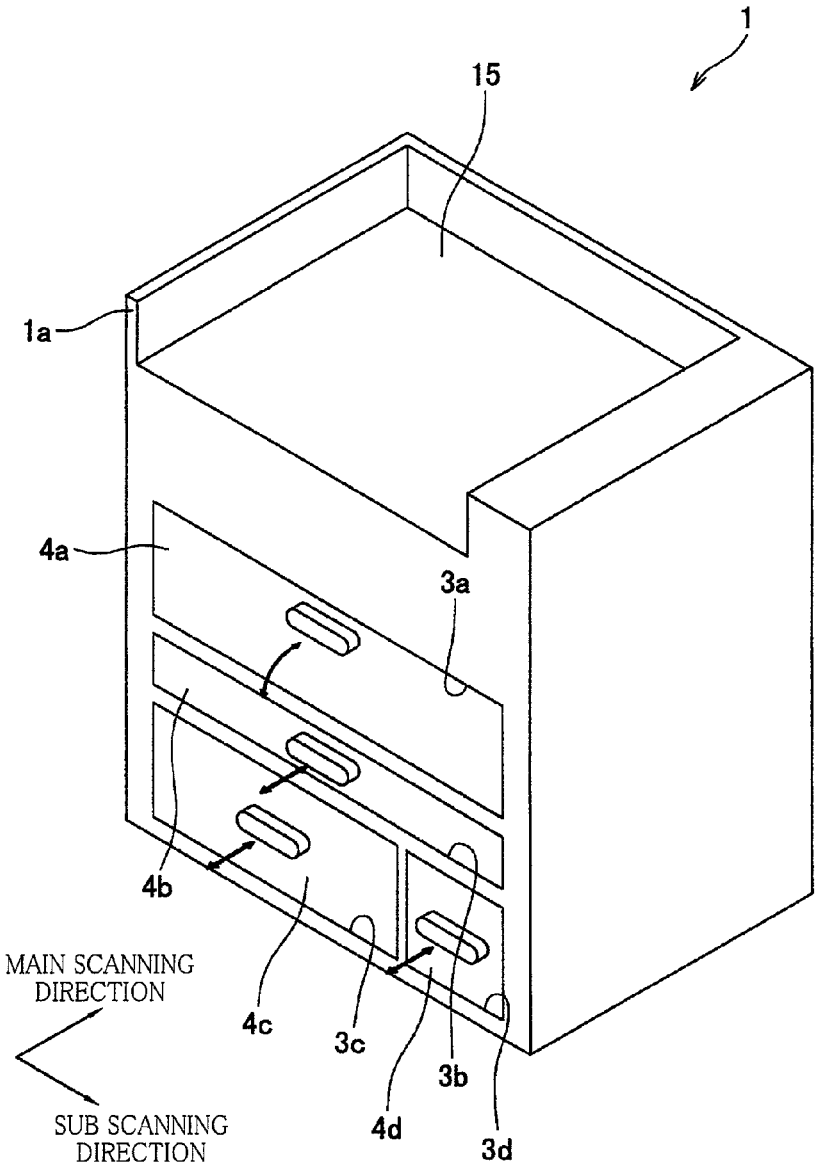
FIG. 1 is a perspective external view of an ink-jet printer according to a first embodiment of the invention.

There will be hereinafter described preferred embodiments of the invention with reference to the drawings. As shown in FIG. 1, an ink-jet printer 1 as an ink-jet recording apparatus according to a first embodiment of the invention has a casing 1*a* which is rectangular parallelepiped and which has four openings 3*a*-3*d* that are formed on the front of the casing 1*a* (on the front surface of the casing 1*a* in FIG. 1). In the opening 3*a*, a door 4*a* is provided so as to be openable and closable about a horizontal axis located at the lower end of the opening 3*a*. A sheet supply unit 4*b*, an ink unit 4*c*, and a waste-ink unit 4*d* are inserted into the opening 3*b*, the opening 3*c*, and the opening 3*d*, respectively. On the upper portion of the casing 1*a*, a discharged-sheet receiving portion 15 is provided. The door 4*a* is disposed so as to be opposed to a conveyor unit 50 in a main scanning direction, i.e., in a depth direction of the casing 1*a*.

Figure 2:
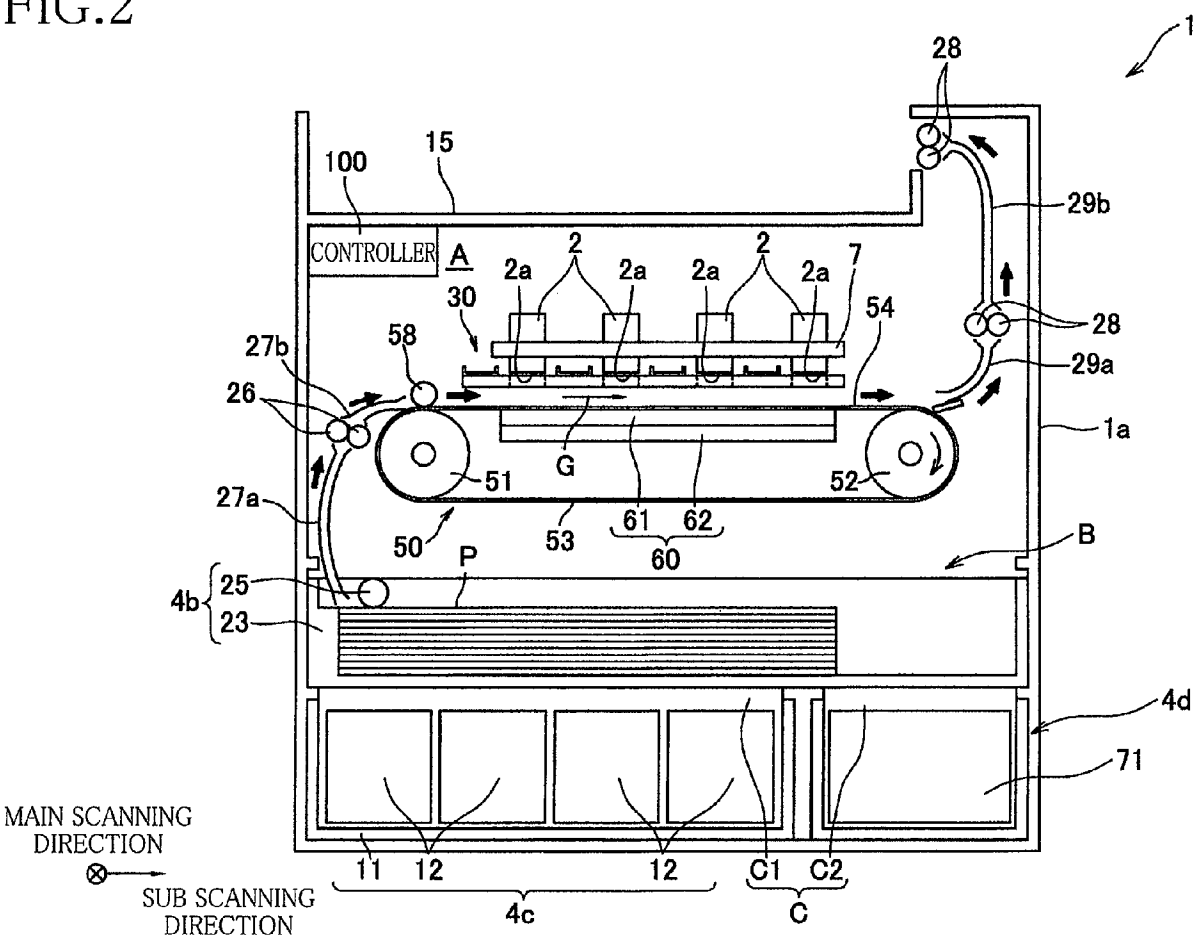
FIG. 2 is a schematic side view showing an internal structure of the ink-jet printer of FIG. 1.

There will be next explained an internal structure of the ink-jet printer 1. As shown in FIG. 2, the inside of the casing 1*a* of the ink-jet printer 1 is divided into three spaces A, B, and C as seen from the top of the casing 1*a*. In the space A, there are disposed in order from the top the four ink-jet heads 2 for respectively ejecting magenta ink, cyan ink, yellow ink, and black ink, a maintenance unit 30, and the conveyor unit 50.

In the space B, the sheet supply unit 4*b* is disposed when the unit 4*b* is installed on the casing 1*a*. The space C is divided into two sub spaces C1 and C2. In the sub space C1, the ink unit 4*c* is disposed when the unit 4*c* is installed on the casing 1*a*. In the sub space C2, the waste-ink unit 4*d* is disposed when the unit 4*d* is installed on the casing 1*a*. These units 4*b*-4*d* are attachable to and detachable from the casing 1*a* in the main scanning direction, i.e., in a direction perpendicular to the sheet plane of FIG. 2. In the present embodiment, a sub scanning direction is a direction parallel to a sheet conveyance direction G in which a sheet P is conveyed by the conveyor unit 50 while the main scanning direction is a direction which is perpendicular to the sub scanning direction and which is horizontal. The ink-jet printer 1 further includes a controller 100 for controlling the sheet supply unit 4*b*, the conveyor unit 50, the maintenance unit 30, the ink-jet heads 2, etc.

Each of the four ink-jet heads 2 has a generally rectangular parallelepiped shape that is long in the main scanning direction. The four ink-jet heads 2 are disposed so as to be spaced apart from each other in the sub scanning direction and are fixed to a frame 7. That is, the ink-jet printer 1 is a line-type printer.

Each ink-jet head 2 has a laminar body having: a flow-passage unit in which are formed ink passages that include pressure chambers; and an actuator for giving pressure to ink in the pressure chambers. The flow-passage unit and the actuator (both not shown) are bonded to each other so as to provide the laminar body. The bottom surface of each ink-jet head 2 is formed as an ejection surface 2*a* from which the ink is ejected. In the ejection surface 2*a*, there are formed a plurality of ejection openings (not shown) through which the ink is ejected.

The ink unit 4*c* has a cartridge tray 11 and four ink cartridges 12 in which are stored the magnet ink, the cyan ink, the yellow ink, and the black ink, respectively, in this order in the sub scanning direction. When the ink unit 4*c* is installed on the casing 1*a* with the four ink cartridges 12 attached to the cartridge tray 11, the four ink cartridges 12 are connected to respective ink supply passages (not shown) that are connected to the respective ink-jet heads 2, so that the inks in the respective ink cartridges 12 can be supplied to the corresponding ink-jet heads 2. At a portion of the ink supply passages, there is disposed a pump device 13 (FIG. 7) configured to forcibly feed the ink in each ink cartridge 12 to the corresponding ink-jet head 2, under the control of the controller 100.

The waste-ink unit 4*d* is connected to ink discharge passages communicating with respective caps 31 that will be explained below. At a portion of the ink discharge passages, there is disposed a suction pump device 40 (FIG. 7) as a discharge mechanism configured to suck the ink in each cap 31 so as to discharge the sucked ink into the waste-ink unit 4*d* through an ink discharge opening 31*a* formed in the cap 31, under the control of the controller 100. As shown in FIG. 2, an ink absorbing member 71 formed of a porous member such as a sponge is disposed in the waste-ink unit 4*d* for absorbing the discharged ink. The waste-ink unit 4*d* is configured to be attachable to and detachable from the casing 1*a*. Accordingly, the waste-ink unit 4*d* can be replaced with new one.

In the inside of the ink-jet printer 1, there is formed a sheet transfer or conveyance path through which the sheet P is transferred or conveyed from the sheet supply unit 4*b* toward the discharged-sheet receiving portion 15 along the solid arrows indicated in FIG. 2. The sheet supply unit 4*b* has a sheet tray 23 capable of accommodating a plurality of sheets P, a sheet supply roller 25 attached to the sheet tray 23, and a sheet supply motor 121 (FIG. 7) configured to rotate the sheet supply roller 25.

The sheet supply roller 25 is configured to supply an uppermost one of the sheets P accommodated in the sheet tray 23. At the left-side portion of the conveyor unit 50 as seen in FIG. 2, there are disposed: sheet guides 27*a*, 27*b* each extending in a curved form from the sheet tray 23 toward the conveyor unit 50; and a feed roller pair 26 disposed between the sheet guides 27*a*, 27*b*. One roller of the feed roller pair 26 is rotated by a feed motor 122 (FIG. 7) while the other roller is a driven roller that is rotated by rotation of the one roller. The sheet supply motor 121 and the feed motor 122 are controlled by the controller 100.

In the structure described above, the sheet supply roller 25 and the rollers of the feed roller pair 26 are rotated under the control of the controller 100, whereby the sheet P contacting the sheet supply roller 25 is transferred to the sheet guide 27*a*, subsequently to the sheet guide 27*b* while being held by the rollers of the feed roller pair 26, and finally to the conveyor unit 50.

The conveyor unit 50 includes two belt rollers 51, 52, an endless conveyor belt 53 wound around the two belt rollers 51, 52 so as to be stretched therebetween, and a conveyance motor 123 (FIG. 7) configured to rotate the belt roller 52. The conveyor unit 50 is configured to convey the sheet P in the sheet conveyance direction G indicated in FIG. 2.

The conveyor belt 53 is formed with a plurality of through-holes (not shown) formed through the thickness thereof. These holes are formed so as to be distributed over the entirety of a conveyor surface (outer circumferential surface) 54 on which the sheet P is held or supported.

As shown in FIG. 2, an adhesion device 60 is disposed in a region enclosed by the conveyor belt 53 so as to be opposed to the ink-jet heads 2. The adhesion device 60 includes a platen 61 having a generally rectangular parallelepiped shape and a fan 62 disposed below the platen 61. On the upper surface of the platen 61, a plurality of holes (not shown) are formed through the thickness of the platen 61. These holes are distributed over the entirety of the platen 61.

As shown in FIG. 2, the upper surface of the platen 61 is held in contact with the inner circumferential surface of the conveyor belt 53 at the upper portion of the loop of the belt 53 so as to support the belt 53 from the inside of the loop. According to the arrangement, the conveyor belt 53 at the upper portion of the loop and the ejection surfaces 2*a* of the ink-jet heads 2 are opposed to each other so as to be parallel to each other, and there is formed a slight clearance between the ejection surfaces 2*a* and the conveyor surface 54 of the conveyor belt 53. The clearance partially constitutes the sheet transfer path.

The fan 62 has a generally rectangular parallelepiped shape shown in FIG. 2. The fan 62 is configured to suck in the air through suction ports (not shown) formed in its upper surface by rotation of rotary vanes provided in its inside. The fan 62 is controlled by the controller 100.

A pressing roller 58 is disposed on the upstream side of one of the four ink-jet heads 2 that is disposed on the most upstream side in the sheet conveyance direction G among the four ink-jet heads 2, so as to be opposed to the belt roller 51 with the conveyor belt 53 interposed therebetween. The pressing roller 58 is biased toward the conveyor surface 54 by an elastic member such as a spring and is configured to press the sheet P supplied from the sheet supply unit 4*b* onto the conveyor surface 54. The pressing roller 58 is a driven roller configured to be rotated in accordance with the rotary movement of the conveyor belt 53.

In this structure, the conveyor belt 53 rotates by rotation of the belt roller 52 clockwise in FIG. 2 under the control of the controller 100. In this instance, the belt roller 51 and the pressing roller 58 are also rotated by the rotary movement of the conveyor belt 53. Further, the fan 62 is driven under the control of the controller 100, so that the air is sucked through the suction ports formed in the fan 62 and the plurality of holes formed in the platen 61. According to the arrangement, the sheet P supplied from the sheet supply unit 4*b* is conveyed in the sheet conveyance direction G while adhering to the conveyor surface 54. In the structure, when the sheet P conveyed by and held on the conveyor surface 54 of the conveyor belt 53 passes right below the four ink-jet heads 2, the ink-jet heads 2 controlled by the controller 100 eject the respective inks toward the sheet P, so that an intended color image is formed on the sheet P.

Figure 3:
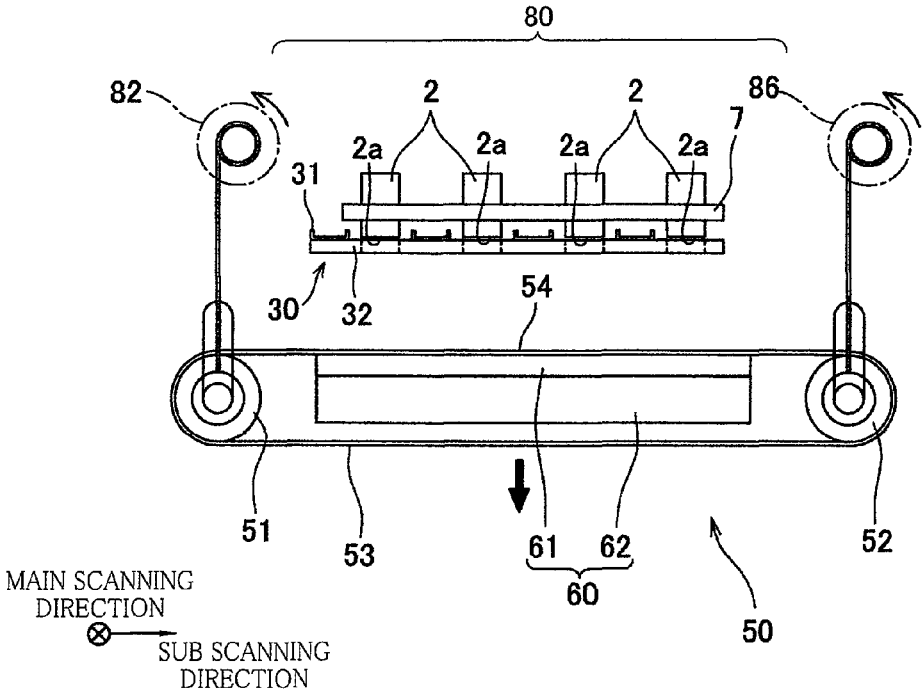
FIG. 3 is a schematic side view showing an up/down moving mechanism for moving a conveyor unit upward and downward.

As shown in FIG. 3, the conveyor unit 50 is configured to be moved upward and downward relative to the ink-jet heads 2 by an up/down moving mechanism 80 between a recording position at which an image is recorded or printed on the sheet P with the inks ejected from the ink-jet heads 2 and a retracted position at which a distance by which the ejection surfaces 2*a* and the conveyor unit 50 are spaced apart from each other is larger than that when the ink-jet heads 2 and the conveyor unit 50 are located at the recording position. Each of the recording position and the retracted position is defined by relative positions of the ink-jet heads 2 and the conveyor unit 50. In other words, the conveyor unit 50 is moved upward and downward between the recording position shown in FIG. 2 at which the conveyor unit 50 is located close to the ink-jet heads 2 and the retracted position at which the conveyor unit 50 is located at a height level lower than the recording position.

The movement of the conveyor unit 50 from the recording position to the retracted position is conducted in an instance where a maintenance operation of the ink-jet heads 2 is conducted. While the conveyor unit 50 is configured to be moved upward and downward relative to the ink-jet heads 2 by the up/down moving mechanism 80 in the present embodiment, the ink-jet heads 2 may be configured to be moved upward and downward relative to the conveyor unit 50 by the up/down moving mechanism 80. Further, both of the ink-jet heads 2 and the conveyor mechanism 50 may be configured to be moved upward and downward such that the conveyor mechanism 50 and the ink-jet heads 2 approach each other or separate away from each other.

At the right-side portion of the ink-jet heads 2 as seen in FIG. 2, there are disposed: sheet guides 29*a*, 29*b* each extending in a curved form from the conveyor unit 50 toward the discharged-sheet receiving portion 15; and two feed roller pairs 28. The sheet P discharged from the conveyor unit 50 is transferred upward in FIG. 2 through the sheet guides 29*a*, 29*b* while being held by the feed roller pairs 28 and is finally discharged onto the discharged-sheet receiving portion 15.

As shown in FIG. 2, the maintenance unit 30 is disposed between the four ink-jet heads 2 and the conveyor unit 50. The maintenance unit 30 has four caps 31 configured to cover the ejection surfaces 2*a* of the respective ink-jet heads 2. Each of the caps 31 has a width as measured in the sub scanning direction that is smaller than a distance between any adjacent two ink-jet heads 2. In other words, the four ink-jet heads 2 are arranged in the sub scanning direction so as to be spaced apart from each other by a distance larger than the width of each cap 31 as measured in the sub scanning direction.

As shown in FIGS. 2 and 4, each cap 31 has a shape that is long in the main scanning direction, and the longitudinal direction of the cap 31 is parallel to the longitudinal direction of the ink-jet heads 2. Each of the caps 31 is located, in its initial state, on the immediately upstream side of the corresponding ink-jet head 2 in the sheet conveyance direction G. More specifically, the most upstream one of the four caps 31 in the sheet conveyance direction G is located on the upstream side of the most upstream one of the four ink-jet heads 2, and each of the other three caps 31 is located between corresponding two ink-jet heads 2 so as to be arranged in order in the sheet conveyance direction G. The four caps 31 are moved, in accordance with the movement of the maintenance unit 30, in the leftward and rightward direction and in the upward and downward direction as seen in FIG. 2, relative to the corresponding ink-jet heads 2.

Figure 4A:
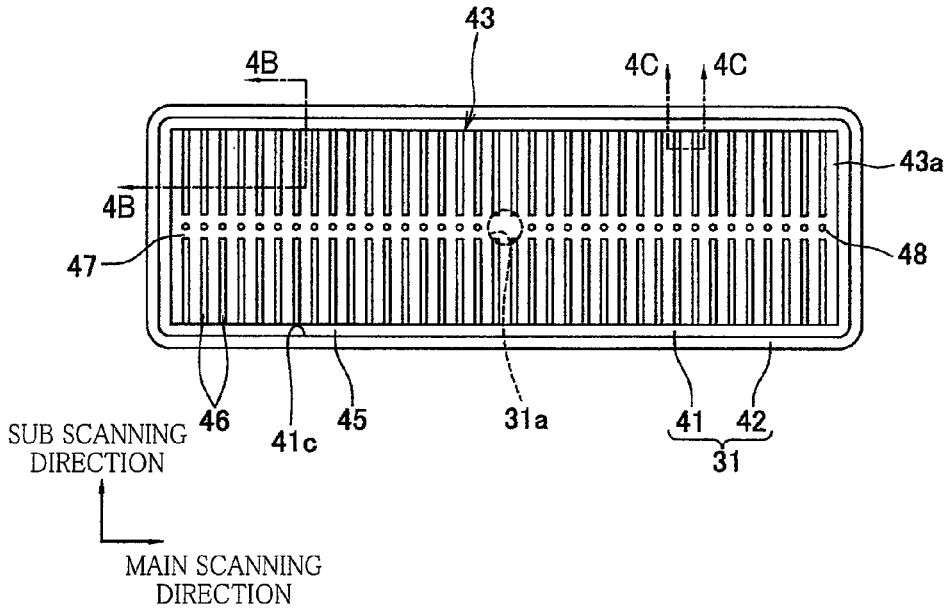
FIG. 4A is a plan view of a cap.
Figure 4B:
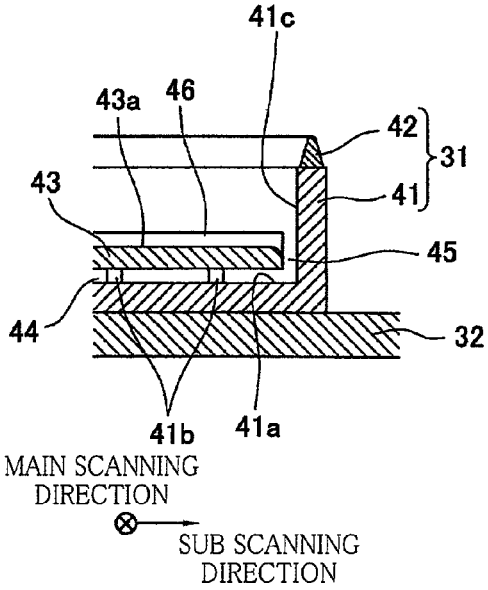
FIG. 4B is a cross sectional view taken along line 4B-4B of FIG. 4A.
Figure 4C:
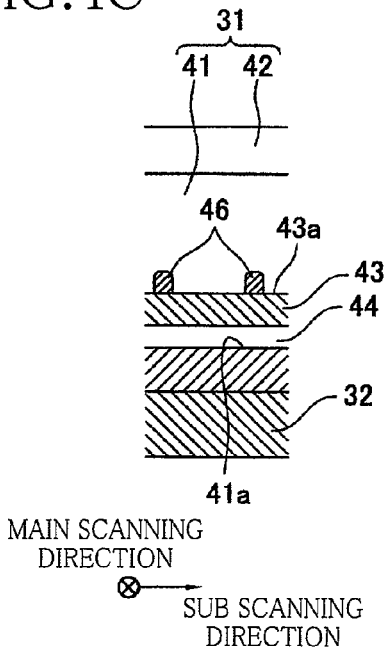
FIG. 4C is a cross sectional view taken along line 4C-4C of FIG. 4A.
Figure 6A:
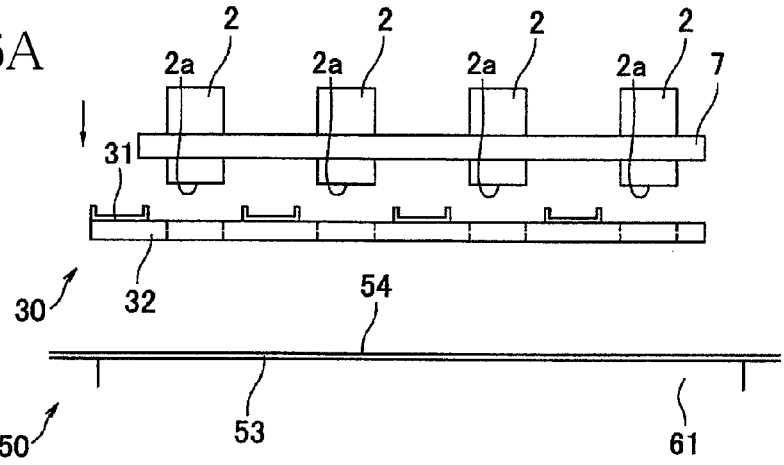
FIGS. 6A-6C are partial side views of the ink-jet printer for explaining a capping operation.

As shown in FIGS. 4A-4C, each cap 31 has a support member 41 having a recessed shape opening upward and an annular protrusion 42 fixed to the open end surface of the support member 41. The annular protrusion 42 is formed of an elastic material such as a rubber. The annular protrusion 42 is configured to come into contact with the ejection surface 2*a* and to cooperate with the support member 41 to define a recessed portion for covering the plurality of ejection openings, as shown in FIG. 6C. At the central portion of a bottom surface 41*a* of the support member 41, namely, at the central portion of a bottom surface of the recessed portion, an ink discharge opening 31*a* is formed, as shown in FIG. 4A.

As shown in FIG. 4B, a cap chip 43 as a plate member is disposed in each cap 31. The cap chip 43 is fixed on a plurality of protuberances 41*b* formed on the bottom surface 41*a*, and there is formed a space 44 between the cap chip 43 and the bottom surface 41*a*. The cap chip 43 is fixed on the protuberances 41*b* so as to form, between the inner peripheral surface 41*c* of the support member 41 and the cap chip 43, a gap 45 having a size that permits a capillary phenomenon to occur.

On an upper surface 43*a* of the cap chip 43, a plurality of protrusions 46 are arranged so as to be equally spaced apart from each other in the main scanning direction. Each protrusion 46 extends from one end to the other end of the upper surface 43*a* in the sub scanning direction, namely, extends between widthwise opposite ends of the upper surface 43*a*. At a middle portion of the upper surface 43*a* in the sub scanning direction, there are formed a plurality of separations 47 by each of which a corresponding one of the protrusions 46 is divided into two segments in the sub scanning direction. In this arrangement, it may be considered that two protrusions 46 are aligned with each other in the sub scanning direction with a space interposed therebetween. The top of each protrusion 41 is rounded as shown in FIG. 4C, whereby the ink does not tend to remain on each protrusion 46. The top of each protrusion 46 may be tapered by chamfering corners thereof. Like the protrusions 46 having the rounded top, the protrusions having the tapered top are effective for preventing the ink from remaining thereon.

As shown in FIG. 4A, the cap chip 43 is formed with a plurality of through-holes 48 which are formed through the thickness thereof so as to connect the upper and lower surfaces thereof, whereby the ink can be flowed into the space 44 through the through-holes 48. The through-holes 48 are arranged in the main scanning direction, and opening portions of the through-holes 48 are located at any of the separations 47. That is, the opening portions of the through-holes 48 are located at all of the separations 47 except two separations 47 which overlap the ink discharge opening 31*a* as seen from above the cap chip 43, in other words, as seen in the vertical direction, i.e., in a direction perpendicular to the bottom surface 41*a* of the support member 41. Each through-hole 48 has a diameter smaller than that of the ink discharge opening 31*a*, in other words, the opening portion of each through-hole 48 has a size smaller than a size of the ink discharge opening 31*a* and does not overlap the ink discharge opening 31*a* as seen from above the cap chip 43, in other words, as seen in the vertical direction or the direction perpendicular to the bottom surface 41*a* of the support member 41. The arrangement prevents a reduction in the suction force through the ink discharge opening 31*a*, namely, a reduction in the suction force through the through-holes 48 and the gap 45.

As shown in FIG. 4B, a corner defined by the one end of the upper surface 43*a* of the cap chip 43 (i.e., one of the widthwise opposite ends of the upper surface 43*a*) and one of side surfaces of the cap chip 43 that corresponds to the one end is rounded. While not shown, a corner defined by the other end of the upper surface 43*a* of the cap chip 43 and the other of the side surfaces of the cap chip 43 that corresponds to the other end is similarly rounded. According to the arrangement, the ink tends to flow into the gap 45 between the cap chip 43 and the inner peripheral surface of the support member 41. The corners may be beveled by chamfering, whereby the similar effect is obtained.

Figure 5A:
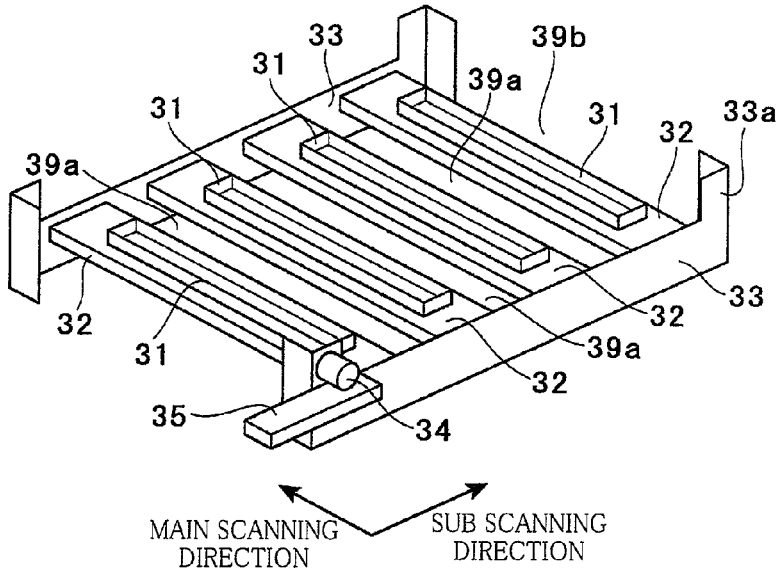
FIGS. 5A and 5B are perspective views showing a maintenance unit.

As shown in FIG. 5A, the maintenance unit 30 includes: four plates 32 which are equally spaced apart from each other in the sub scanning direction and each of which has the cap 31 disposed on its upper surface; and a pair of inner frames 33 between which the plates 32 are held. Each inner frame 33 has protruding corner portions 33*a* that extend upward at respective opposite ends thereof. On one corner portion 33*a* of each inner frame 33, a pinion gear 34 that is fixed to a shaft of a drive motor 126 (FIG. 7) is disposed so as to mesh with a rack gear 35 disposed horizontally. In FIG. 5A, the pinion gear 34 of only one of the inner frames 33 (that is located on the front side as seen in FIG. 5A) is shown.

Figure 5B:
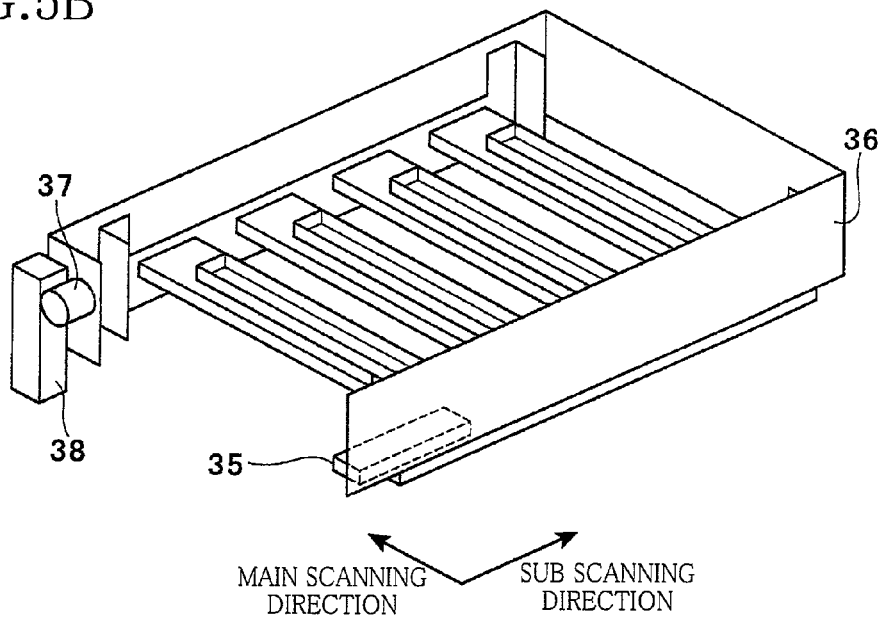
Figure 7:
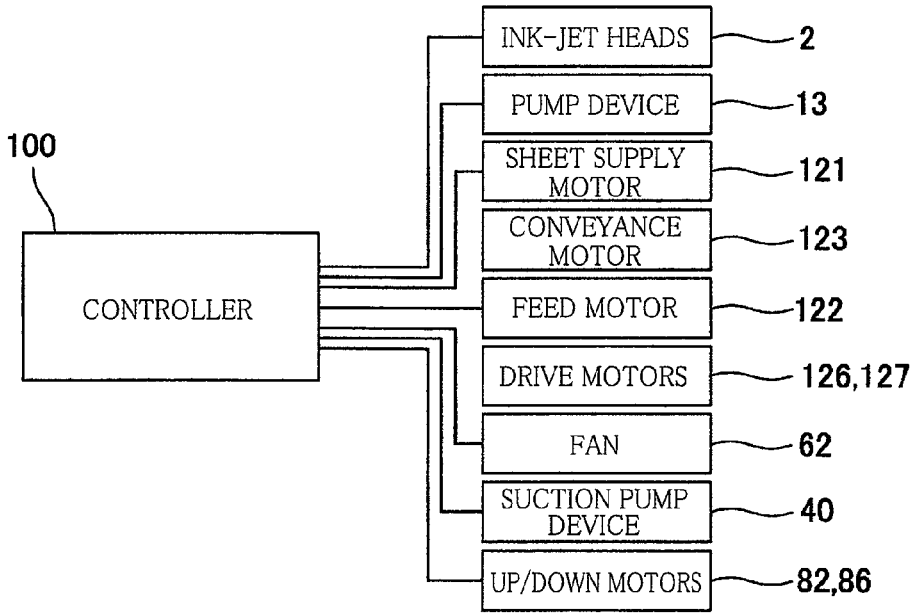
FIG. 7 is a schematic diagram of a control system of the ink-jet printer of FIG. 1.

As shown in FIG. 5B, the maintenance unit 30 further includes an outer frame 36 disposed so as to enclose the pair of inner frames 33. Inside the outer frame 36, the rack gear 35 shown in FIG. 5A is fixed. The outer frame 36 is provided with a pinion gear 37 that is fixed to a shaft of a drive motor 127 (FIG. 7). The pinion gear 37 is disposed so as to mesh with a rack gear 38 disposed vertically. The rack gear 38 is disposed so as to extend upright in the casing 1*a*.

In the arrangement described above, when the two pinion gears 34 are synchronously rotated under the control of the controller 100, the inner frames 33 are moved in the sub scanning direction. Further, when the pinion gear 37 is rotated under the control of the controller 100, the outer frame 36 is moved in the vertical direction.

More specifically, when the maintenance unit 30 is located at an initial position shown in FIG. 2, each plate 32 is located on the immediately upstream side of the corresponding inkjet head 2 in the sheet conveyance direction. G, and three openings 39*a* between any adjacent two plates 32 and one opening 39*b* between the most downstream one of the plates 32 in the sheet conveyance direction G and the corner portions 33*a* of the inner frame 33 are opposed to the respective ejection surfaces 2*a*. When a capping operation for covering the ejection surfaces 2*a* with the corresponding caps 31 is conducted, the outer frame 36 is initially moved downward in the vertical direction, so that the caps 31 are moved to an intervening position at which the caps 31 are located between the ink-jet heads 2 and the conveyor unit 50 and at which the caps 31 and the ejection surfaces 2*a* are spaced apart from each other as seen in the sub scanning direction, as shown in FIG. 6A. On this occasion, the caps 31 are located at a position at which the caps 31 are not opposed to the ejection surfaces 2*a*.

Figure 6B:
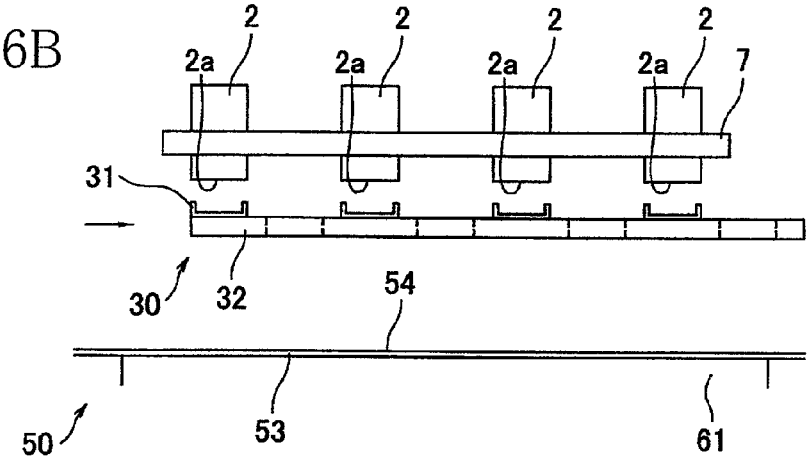
Figure 6C:
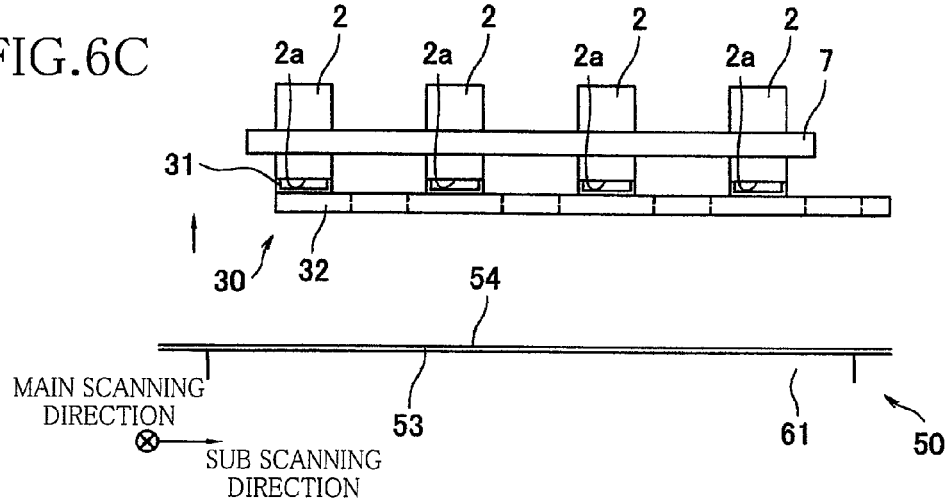

Thereafter, the pair of inner frames 33 are moved downstream in the sheet conveyance direction G, so that the caps 31 are located at a facing position at which the caps 31 face the corresponding ejection surfaces 2*a*, as shown in FIG. 6B. Then the outer frame 36 is moved upward in the vertical direction, whereby the caps 31 are located at a capping position at which the caps 31 contact the corresponding ejection surfaces 2*a* so as to cover the same 2*a*, as shown in FIG. 6C. According to this procedure, the ejection surfaces 2*a* are covered with the respective caps 31. The caps 31 return back to the initial position by conducting the procedure in a reverse order. The drive motor 127, the pinion gear 37, and the rack gear 38 constitute a moving mechanism configured to move the maintenance unit 30 such that the caps 31 are selectively placed between a state in which the annular protrusion 42 is held in contact with the corresponding ejection surface 2*a* and a state in which the annular protrusion 42 is spaced apart from the corresponding ejection surface 2*a*.

The capping operation described above is conducted with the conveyor unit 50 located at the retracted position after having been moved downward from the recording position by the up/down moving mechanism 80. Further, the capping operation is conducted when a purging operation for eliminating the ink ejection failure state of the ink-jet heads 2 is conducted. It is noted that FIG. 6 shows a state in which the conveyor unit 50 is located at the retracted position after having moved from the recording position by the up/down mechanism 80.

Next, the controller 100 will be explained referring to FIG. 7. The controller 100 is constituted by a general-purpose personal computer, for instance. The computer has hardware such as a CPU, a ROM, a RAM, a hard disk, etc. In the hard disk, there are stored various sorts of software including programs for controlling the operations of the printer 1. The controller 100 controls the ink-jet heads 2, motors 82, 86, 121-127, the fan 62, the pump device 13, and the suction pump device 40.

Figure 8A:
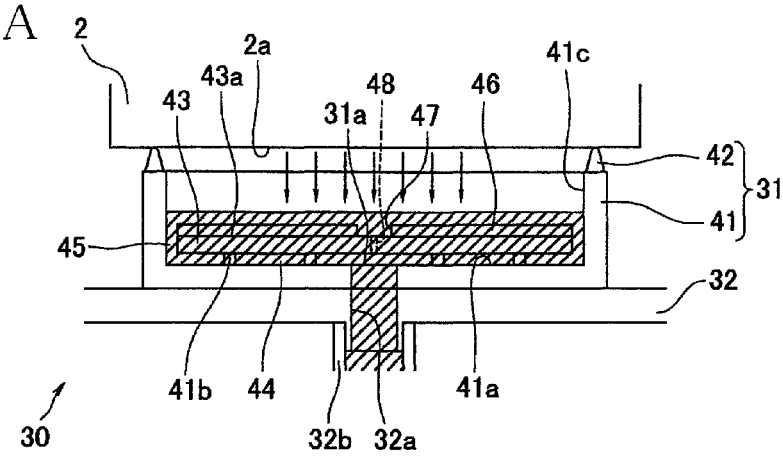
FIGS. 8A-8D are cross sectional views of the cap showing an ink flowing state when purged ink is discharged from the cap.

Next, the maintenance operation will be explained with reference to FIG. 8. In FIG. 8, portions of the caps 31 in cross section are not hatched. Instead, the ink in the cap 31 is hatched for easy view of the state of the ink in the cap 31. The maintenance operation includes the purging operation, a waste-ink discharging operation, and so on. When the ink-jet heads 2 suffer from ink ejection failure, for instance, the purging operation for purging the ink through the ejection openings is conducted. In this instance, the controller 100 controls up/down motors 82, 86 to move the conveyor unit 50 from the recording position to the retracted position. Next, the controller 100 controls the drive motor 127 to move the maintenance unit 30 to the intervening position. Then the controller 100 controls the drive motor 126 to move the caps 31 to the facing position and subsequently controls the drive motor 127 to move the caps 31 to the capping position. Thereafter, the controller 100 drives the pump device 13 for a predetermined time, whereby the ink in each ink cartridge is forcibly fed to the corresponding inkjet head 2 and the ink in the ink-head 2 is purged therefrom into the corresponding cap 31. On this occasion, the ink is purged from the ink-jet head 2 into the cap 31 such that the liquid level of the ink is located above the tops of the protrusions 46, as shown in FIG. 8A. After purging, the controller 100 controls the drive motor 127 to move the caps 31 from the capping position to the intervening position, and the waste-ink discharging operation described below is conducted.

The controller 100 then drives the suction pump device 40 for a predetermined time, e.g., for 20-30 seconds, so that the ink in each cap 31 is discharged into the waste-ink unit 4*d* through the ink discharge opening 31*a*, an aperture 32*a* of the corresponding plate 32 communicating with the ink discharge opening 31*a*, and a tube 32*b* connected to the aperture 32*a*. The suction pump device 40 is disposed at a suitable portion of the tubes 32*b* connected to the apertures 32*a* of the respective plates 32. The ink on the cap chip 43 flows into the space 44 through the gap 45 and the through-holes 48 by the suction force of the suction pump device 40 and is discharged through the ink discharge opening 31*a*.

When the liquid level of the ink in the cap 31 is located below the tops of the protrusions 46, the ink hardly remains on the tops of the protrusions 46 since the tops of the protrusions 46 are rounded. Further, since the corner defined respectively by the opposite ends of the upper surface 43*a* of the cap chip 43 in the sub scanning direction and the corresponding side surfaces of the cap chip 43 are rounded, the ink on the cap chip 43 tends to easily flow into the gap 45.

Figure 8B:
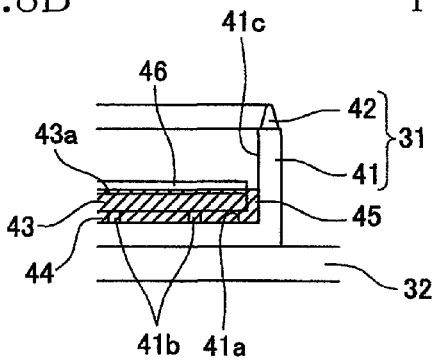
Figure 8C:
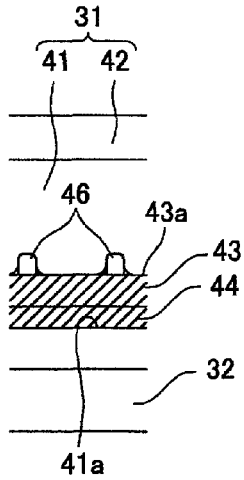
Figure 8D:
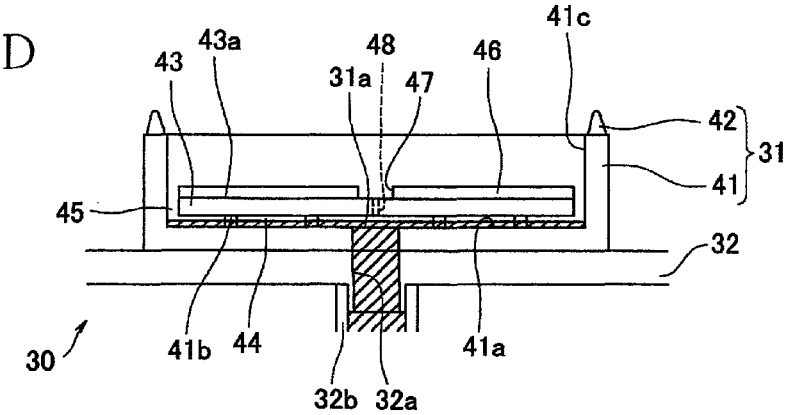

When the liquid level of the ink is located at substantially the same height level as the upper surface 43*a* shown in FIGS. 8B and 8C, the ink on the cap chip 43 gathers or accumulates at corner portions each defined by either one of side faces of each protrusion 46 and the upper surface 43*a*, owing to surface tension. The ink gathered or accumulated at the corner portions is initially drawn toward the one and the other ends of the upper surface 43*a* in the sub scanning direction owing to the suction force by the suction pump device 40 at the entirety of the gap 45, thereafter flows into the space 44, and is finally discharged from the ink discharge opening 31*a*. As the ink is discharged, the ink discharge opening 31*a* is brought into communication with the atmosphere somewhere at the through-holes 48 and the gap 45, so that the suction force at the gap 45 is lowered. However, the ink accumulated at the corner portions is drawn toward the one and the other ends of the upper surface 43*a* of the cap chip 43 in the sub scanning direction, owing to the capillary phenomenon of the gap 45. The ink drawn to the gap 45 flows into the space 44 as shown in FIG. 8D and is discharged from the ink discharge opening 31*a*. While the ink in the cap 31 remains in the space 44 to a certain degree, the ink hardly remains on the cap chip 43. Further, the ink remaining in the space 44 is hard to contact the atmosphere, so that the ink is hard to dry. Accordingly, even where the ink-jet heads 2 are not used for a relatively long period with the ejection surfaces 2*a* covered with the corresponding caps 31, the aqueous component of the ink in the vicinity of the ejection openings of the ink-jet heads 2 is prevented from being absorbed, so that the viscosity of the ink in the vicinity of the ejection openings is inhibited from increasing.

Further, since the separation 47 is formed in each protrusion 46, the capillary force is imbalanced at opposite ends of each protrusion 46, in other words, the ink exiting at one side of the separation 47 undergoes the capillary force at only one of the opposite ends of the protrusion 46. Accordingly, the ink accumulated at the corner portions owing to the surface tension tends to be easily drawn toward the one and the other ends of the cap chip 43, so that the ink does not tend to stay on the cap chip 43. While, in the present embodiment, the plurality of through-holes 48 are formed in the cap chip 43, the through-holes 48 have a relatively small diameter and the number of the through-holes 48 is less than that of the separations 47, in other words, the number of the through-holes 48 formed in the cap chip 43 is not so many. Accordingly, the arrangement enables the ink to be efficiently discharged without lowering the suction force, as compared with an arrangement in which a multiplicity of through-holes are formed in the cap chip 43. It is noted that the through-holes 48 may not be formed in the cap chip 43 for further increasing the suction force. Even where the through-holes 48 are not formed, the ink on the corners of the cap chip 43 can be flowed into the space 44 through the gap 45, whereby the ink is prevented from remaining on the cap chip 43 and the suction force can be enhanced for efficient discharging of the ink.

Thereafter, the controller 100 stops driving of the suction pump device 40, so that the discharging of the ink from the cap 31 is stopped. Thus, the waste-ink discharging operation is ended. In this regard, even if the ink remains on the cap chip 43 at the time point when the waste-ink discharging operation is ended, the ink is introduced into the space 44 owing to the above-described surface tension and capillary phenomenon.

Subsequently, the controller 100 controls the drive motors 126, 127 to move the caps 31 from the facing position back to a position at which the caps 31 do not face the corresponding ejection surfaces 2*a* and to move the maintenance unit 30 from the intervening position back to the initial position. Then the controller 100 controls the up/down motors 82, 86 to move the conveyor unit 50 from the retracted position back to the recording position. Thus, the maintenance operation including the purging operation and the waste-ink discharging operation is ended.

In the ink-jet printer 1 constructed as described above, when the ink purged from each ink-jet head 2 into the corresponding cap 31 is discharged by the suction pump device 40, the ink on the cap chip 43 gathers or accumulate, owing to the surface tension, at the corner portions each defined by either one of the side faces of each protrusion 46 and the upper surface 43*a* of the cap chip 43, and the gathered ink is drawn into the gap 45. The ink thus drawn into the gap 45 then flows into the space 44. Accordingly, it is possible to prevent the ink from staying on the cap chip 43 and to efficiently discharge the ink without forming a large number of through-holes in the cap chip 43, in other words, without lowering the suction force.

Each separation 47 is formed at the middle portion of the upper surface 43*a* in the sub scanning direction, whereby the ink is easily drawn toward the one and the other ends of the cap chip 43 in the sub scanning direction. Further, since each protrusion 46 extends in the sub scanning direction, the distance between the separation 47 and each of opposite ends of the protrusion 46 as measured in the sub scanning direction is made small. Accordingly, the ink tends to be easily drawn toward the one and the other ends of the cap chip 43, namely, into the gap 45.

Figure 9:
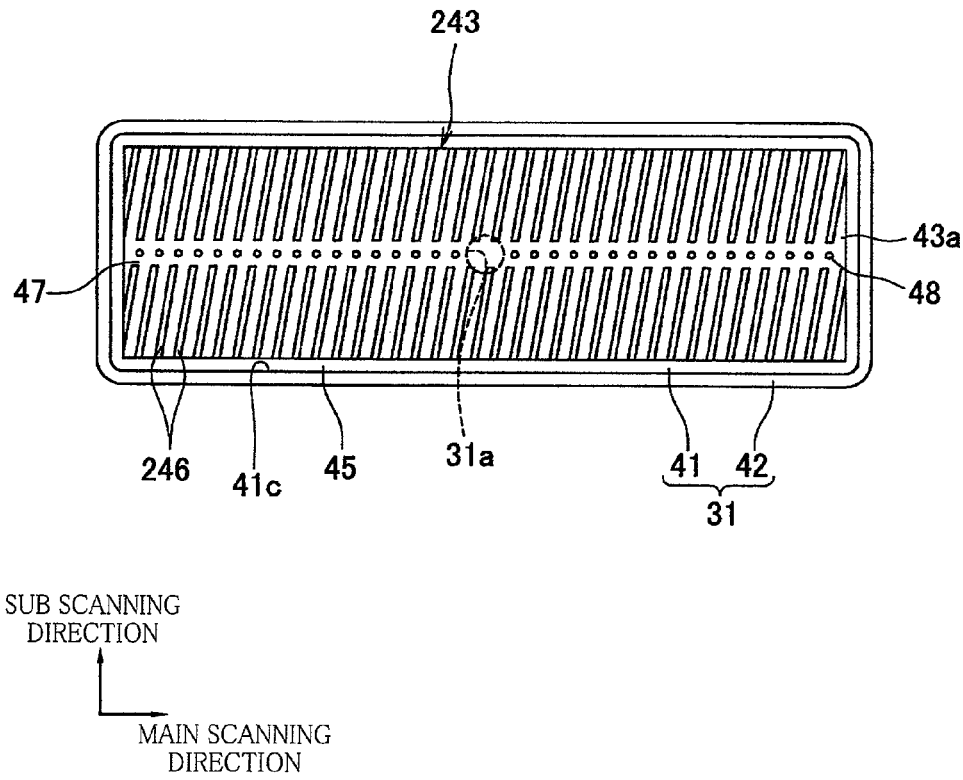
FIG. 9 is a plan view showing a cap in an ink-jet printer according to a second embodiment of the invention.

There will be next explained a cap chip according to a second embodiment of the invention referring to FIG. 9. The second embodiment differs from the illustrated first embodiment in that the shape of protrusions 246 of a cap chip 243 according to the second embodiment is slightly different from the shape of the protrusions 46 of the cap chip 43 according to the first embodiment. Accordingly, the same reference numerals as used in the illustrated first embodiment are used to identify the corresponding components and a detailed explanation of which is dispensed with.

In the cap chip 243 of the second embodiment, each protrusion 246 extends in a direction that is slightly inclined with respect to the sub scanning direction, as shown in FIG. 9. Owing to the thus constructed protrusions 246, the ink tends to easily flow toward the one and the other ends of the cap chip 243 in the sub scanning direction even in an instance where at least one of the cap chip 243 and the cap 31 is inclined in the main scanning direction (in the longitudinal direction) such that one of opposite end portions thereof in the main scanning direction, namely, one of longitudinally opposite end portions thereof, is located at a height level higher or lower than the other of the opposite end portions in the main scanning direction, namely, the other of the longitudinally opposite end portions.

Figure 10:
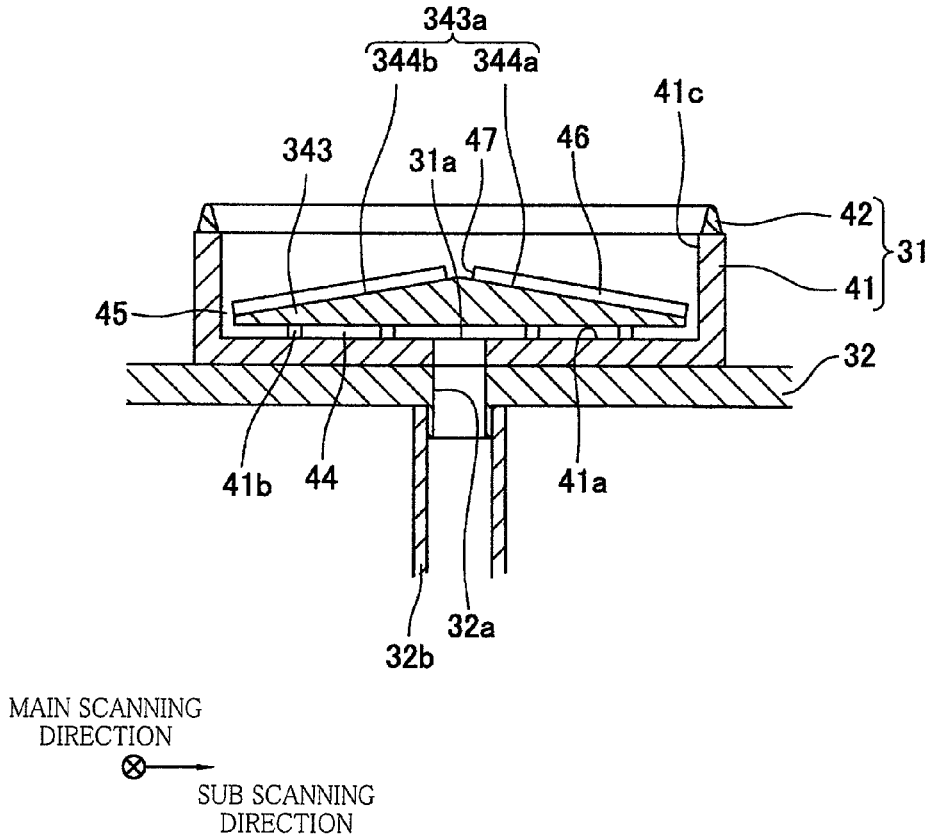
FIG. 10 is a cross sectional view showing a cap in an ink-jet printer according to a third embodiment of the invention.

There will be next explained a cap chip according to a third embodiment of the invention referring to FIG. 10. The third embodiment differs from the illustrated first embodiment in that the cross sectional shape of a cap chip 343 according to the third embodiment is slightly different from the cross sectional shape of the cap chip 43 according to the first embodiment. Accordingly, the same reference numerals as used in the illustrated first embodiment are used to identify the corresponding components and a detailed explanation of which is dispensed with.

In the cap chip 343 of the third embodiment, its upper surface 343*a* is configured such that a middle portion of the upper surface 343*a* in the sub scanning direction is located at a height level higher than the height levels of one and the other ends thereof in the sub scanning direction, as shown in FIG. 10. More specifically, a part 344*a* of the upper surface 344*a* from the middle portion to the one end and a part 344*b* of the upper surface 343*a* from the middle portion to the other end are both inclined. Owing to the thus inclined parts 344*a*, 344*b* of the upper surface 343*a*, the ink tends to more easily flow toward the one and the other ends of the cap chip 343 in the sub scanning direction. As a modified example, only one of the parts 344*a*, 344*b* may be inclined and the other of the parts 344*a*, 344*b* may be made horizontal, whereby the inclined one of the parts 344*a*, 344*b* permits the ink to easily flow into the gap. In other words, in these arrangements, the middle portion of the upper surface 344*a* is not located at a height level lower than height levels of the one and the other ends of the upper surface 344*a*.

While the preferred embodiments of the invention have been described above, it is to be understood that the invention is not limited to the details of the illustrated embodiments, but may be embodied with various other changes and modifications, which may occur to those skilled in the art, without departing from the scope of the invention defined in the appended claims. For instance, the separations 47 in the illustrated first through third embodiments may be formed at a portion of the upper surface 43*a*, 343*a* other than the middle portion in the sub scanning direction. The top of each protrusion 46 may not be rounded or tapered. The corners of the cap chip 43 respectively defined by the corresponding side surfaces of the cap chip 43 and the upper surface 43*a* of the cap chip 43 may not be rounded or beveled. In place of the moving mechanism constituted by the drive motor 127, the pinion gear 37, and the rack gear 38, a moving mechanism for moving the ink-jet heads 2 upward and downward may be provided.

What is claimed is:

1. An ink jet recording apparatus, comprising:

an inkjet head having an ejection surface in which are formed a plurality of ejection openings through which ink is ejected;

a cap including: a support member; an annular protrusion which is fixed to the support member and which is to come into contact with the ejection surface, the annular protrusion cooperating with the support member to define a recessed portion for covering the plurality of ejection openings; and a discharge opening formed in a bottom surface of the recessed portion;

a discharge mechanism configured to discharge, through the ink discharge opening, ink purged from the ink jet head into the cap;

a plate member disposed in the recessed portion of the cap such that a space is formed between the plate member and the bottom surface and such that there is formed, between an inner peripheral surface of the cap and the plate member, a gap in which a capillary phenomenon occurs;

a plurality of protrusions which are disposed on an upper surface of the plate member so as to be arranged in a longitudinal direction of the ink jet head and each of which extends in a direction intersecting the longitudinal direction; and a plurality of separations by each of which a corresponding one of the plurality of protrusions is divided into segments in the direction intersecting the longitudinal direction.

2. The ink jet recording apparatus according to claim 1, wherein the separations are formed at a middle portion of the upper surface in the direction perpendicular to the longitudinal direction.

3. The ink jet recording apparatus according to claim 2, wherein the plate member is formed with a plurality of through-holes which are formed through a thickness thereof and opening portions of the plurality of through-holes that are open to the upper surface are arranged in the longitudinal direction so as to be located at any of the separations, and wherein each of the opening portions of the through-holes has a size smaller than a size of the discharge opening and does not overlap the discharge opening as seen in a direction perpendicular to the bottom surface of the recessed portion.

4. The ink jet recording apparatus according to claim 2, wherein the middle portion of the upper surface is not located at a height level lower than height levels of one end and an other end of the upper surface, and wherein at least one of a part of the upper surface from the middle portion to the one end and a part of the upper surface from the middle portion to the other end is inclined.

5. The ink jet recording apparatus according to claim 1, wherein each of the plurality of protrusions extends in the direction perpendicular to the longitudinal direction.

6. The ink jet recording apparatus according to claim 1, wherein each of the plurality of protrusions extends in a direction that is inclined with respect to the direction perpendicular to the longitudinal direction.

7. The ink jet recording apparatus according to claim 1, wherein a top of each of the plurality of protrusions is one of rounded and tapered.

8. The ink jet recording apparatus according to claim 1, further comprising a moving mechanism configured to move at least one of the cap and the ink jet head such that the annular protrusion is selectively placed in one of a state in which the annular protrusion is in contact with the ejection surface and a state in which the annular protrusion is spaced apart from the ejection surface.

9. The ink jet recording apparatus according to claim 1, wherein each of the plurality of protrusions extends from one end to the other end of the upper surface in a direction perpendicular to the longitudinal direction.

10. The ink jet recording apparatus according to claim 9, wherein a corner defined by the one end of the upper surface and one of side surfaces of the plate member corresponding to the one end and a corner defined by the other end of the upper surface and the other of the side surfaces of the plate member corresponding to the other end are one of rounded and beveled.

* * * * *